US009422087B1

(12) United States Patent
Poran et al.

(10) Patent No.: US 9,422,087 B1
(45) Date of Patent: Aug. 23, 2016

(54) FOLDABLE CRATE AND LOCKING MECHANISMS THEREFOR

(71) Applicant: PLASGAD PLASTIC PRODUCTS ACS LTD., Upper Galilee (IL)

(72) Inventors: Iftah Poran, El-Rom (IL); Yehuda Poran, Egoz (IL)

(73) Assignee: PLASGAD PLASTIC PRODUCTS ACS LTD, Upper Galilee (IL)

( * ) Notice: Subject to any disclaimer, the term of this patent is extended or adjusted under 35 U.S.C. 154(b) by 0 days.

(21) Appl. No.: 14/621,196

(22) Filed: Feb. 12, 2015

(51) Int. Cl.

| | |
|---|---|
| ***B65D 21/08*** | (2006.01) |
| ***B65D 6/26*** | (2006.01) |
| ***B65D 6/18*** | (2006.01) |
| *B65D 6/16* | (2006.01) |

(52) U.S. Cl.
CPC ..... *B65D 21/086* (2013.01); *B65D 7/26* (2013.01); *B65D 7/30* (2013.01); *B65D 11/18* (2013.01); *B65D 11/1833* (2013.01)

(58) Field of Classification Search
CPC ..... B65D 7/30; B65D 7/26; B65D 21/086; B65D 11/1833; B65D 11/18
USPC ..... 220/6, 7, 666
See application file for complete search history.

(56) References Cited

FOREIGN PATENT DOCUMENTS

EP 2840034 A * 7/2014

* cited by examiner

*Primary Examiner* — Stephen Castellano
(74) *Attorney, Agent, or Firm* — Mark David Torche; Patwrite LLC

(57) ABSTRACT

A foldable crate includes a base platform, a pair of longitudinal sidewalls forming a hinged connection with the base platform and a pair of flanking sidewalls forming a hinged connection with the base platform. The flanking sidewalls accommodate a pair of rotary locking elements, as well as unlocking element.

19 Claims, 5 Drawing Sheets

50
63
60
B
84
60
62
68
80
82

50
59
86
63
60
60
80
59
69
50
B
78
82
60

69
59
50
68
78
73
60

FOLDABLE CRATE AND LOCKING MECHANISMS THEREFOR

TECHNICAL FIELD

The present invention pertains to containers, in particular foldable crates and locking mechanism therefor. In particular, the invention relates to advances in and elaborations of locking mechanisms for foldable crates.

BACKGROUND OF THE INVENTION

Foldable crates are widely used these days. There are numerous solutions known in the art for locking mechanisms for foldable crates. The general concept of such locking mechanisms is that a foldable crate can be secured in open conformation, by a locking mechanism, which is releasable by an actuator, typically a tab surrounding the handle of the crate. It is believed that the pertinent state-of-the-art is represented by: U.S. Pat. No. 7,861,878, U.S. Pat. No. 6,290,081, US20100230406, US20120091133 and US20100320202; EP2431283 and EP1655232, as well as by WO2010146190, WO2009100799 and particularly DE10137328.

US20120091133 discloses a collapsible box including a plastic structure with a rectangular base, two ends, and two sides which are pivotably coupled to the base. The ends include centered parts combined with latches, which in one position anchor the sides and ends, while in another position the connection between the ends and the sides is released in order to collapse the elements. The collapsible box of US20120091133 is characterized in that the box includes an anchor device consisting of a series of rotary bodies that connect the latches to the centered part via two pairs of resilient parts and which, in the inoperative position thereof, hold the latches outwards, attaching the ends and the sides. When the central part is moved upward, the latches thus release the ends and the sides.

U.S. Pat. No. 7,861,878 discloses a fastening device for folding boxes. The folding boxes include a bottom and four lateral walls coupled in jointed fashion to the edges of that bottom, two opposite walls each having a fastening device for ensuring the unfolding of the box. The fastening devices of U.S. Pat. No. 7,861,878 include a vertically displaceable central piece and lateral bolts with horizontal displacement for fastening the lateral walls via their adjacent edges. The fastening device of U.S. Pat. No. 7,861,878 includes elastic spring elements that link the central control piece with pairs of the lateral bolts. The spring elements, in the rest position, maintain the bolts in an engagement and fastening position. The release position of the bolts in U.S. Pat. No. 7,861,878 results when the spring elements pull the bolts against the resistance of the elastic elements.

DE10137328 that is considered the most relevant prior art publication discloses an assembly, adapted to open and close side walls of a plastic and reusable box or container, which have a manual locking unit, with at least one projection, which grips over a ratchet hook on the longitudinal wall. The lock operating control is adapted to grip, carry the box or container and also unlock the side walls.

SUMMARY OF THE INVENTION

The invention relates to advances in and elaborations of locking mechanisms for foldable crates.

There is provided in accordance with embodiments of the present invention a foldable crate including a base platform, a pair of longitudinal sidewalls forming a hinged connection with the base platform and a pair of flanking sidewalls forming a hinged connection with the base platform. The flanking sidewalls accommodate a locking mechanism and unlocking mechanism.

In accordance with some embodiments of the present invention, the locking mechanism includes a pair of rotary locking elements, pivoting upon axes on flanking sidewalls, as well as a pair of respective protrusions inwardly facing from longitudinal sidewalls.

In accordance with some embodiments of the present invention, the unlocking mechanism includes a manual deactivator, configured to exert a rotational torque upon rotary locking elements.

It should be understood, however, that the summary above is not intended to limit the invention to the particular forms and examples, rather on the contrary, is to cover all modifications, equivalents, and alternatives falling within the scope of the invention.

BRIEF DESCRIPTION OF THE DRAWINGS

The present invention will be understood and appreciated more comprehensively from the following detailed description taken in conjunction with the appended drawings in which.

Figure 1:
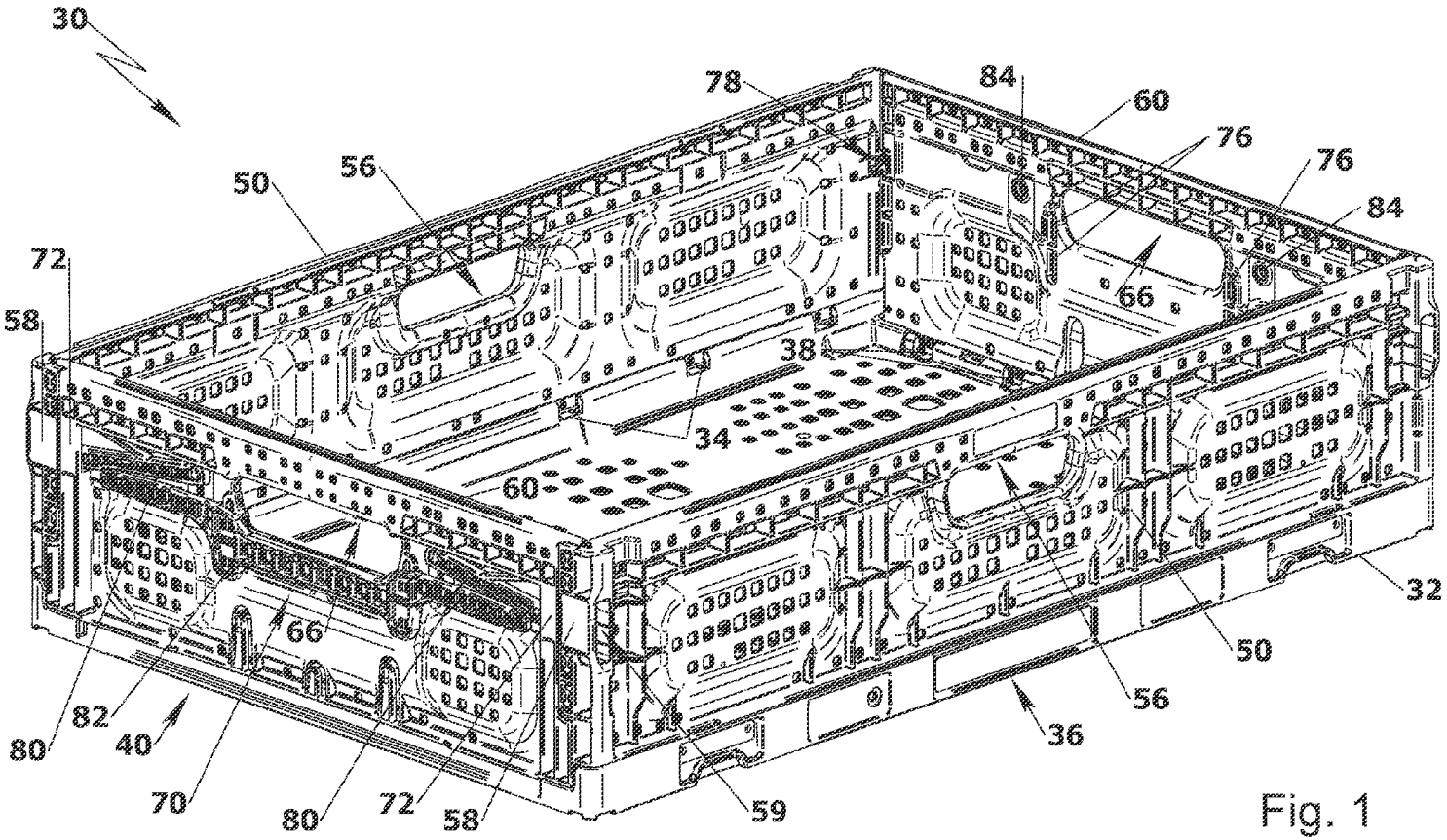
FIG. 1 an isometric view of an assembled foldable crate in an open conformation and locking/unlocking mechanism therefor, in accordance with an embodiment of the present invention.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DESCRIPTION OF THE INVENTION

Illustrative embodiments of the invention are described below. In the interest of clarity, not all features of actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another. Moreover, it will be appreciated that the effort of such a development might be complex and time-consuming, but would nevertheless be a routine undertaking for those of ordinary skill in the art having the benefit of this disclosure.

Figure 2:
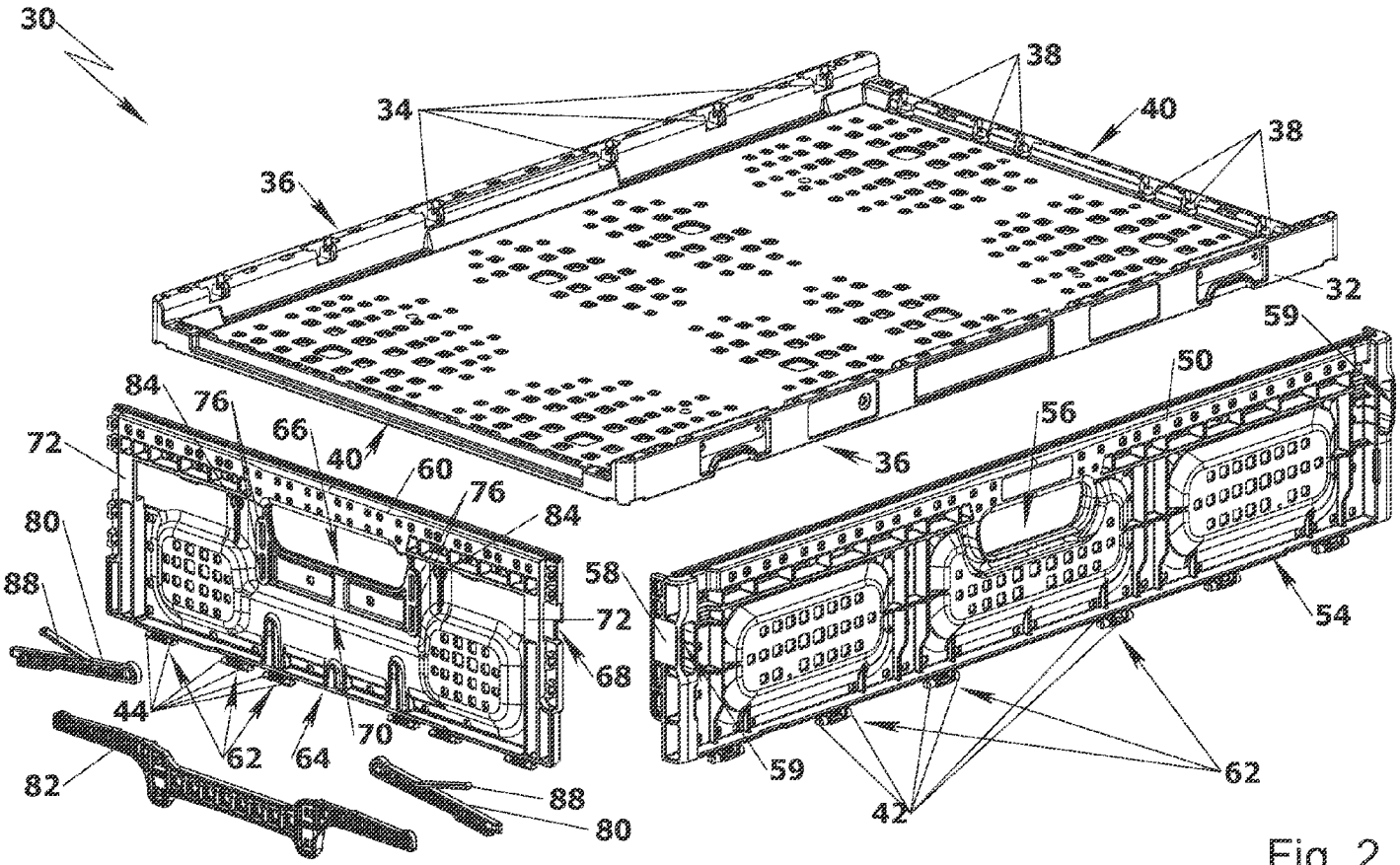
FIG. 2 is an exploded isometric view of a base platform, a longitudinal sidewall and a flanking sidewall of an embodiment of the foldable crate as well as of a pair of rotary locking elements of the locking mechanism thereof and manual deactivator of the unlocking mechanism thereof.
Figure 3B:
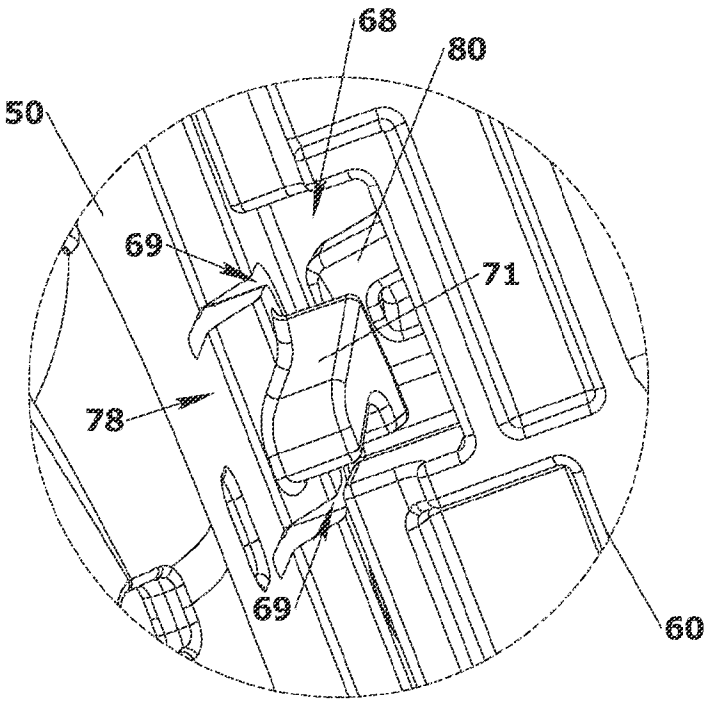
FIG. 3B is an enlarged posterior perspective elevated view of the locking mechanism of the foldable crate shown in FIG. 3A.
Figure 3A:
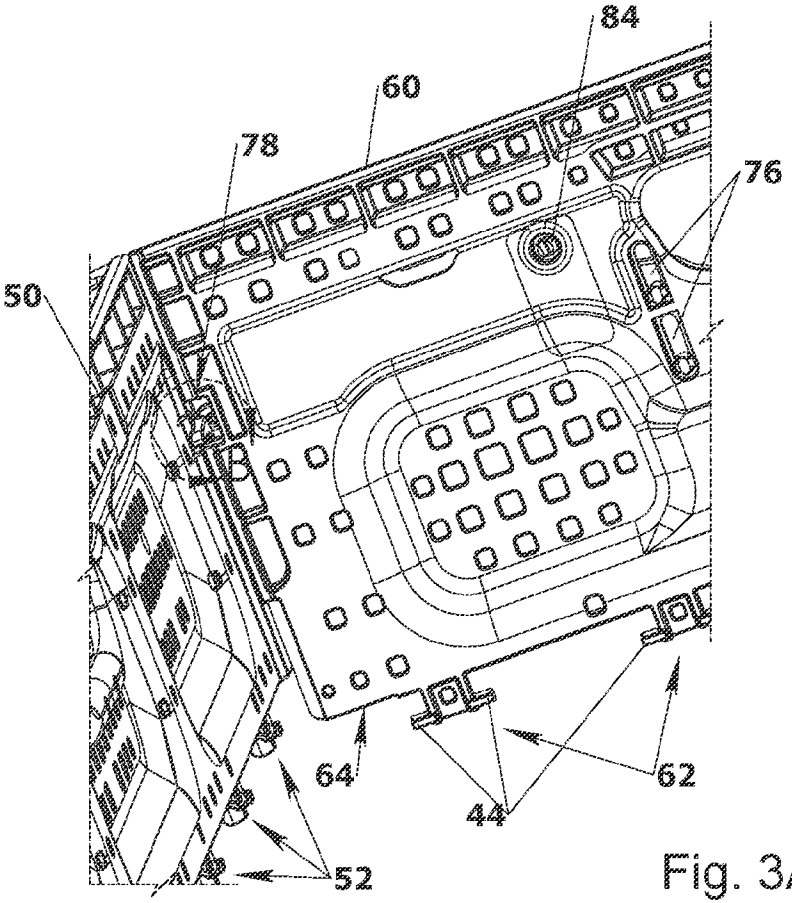
FIG. 3A is a posterior perspective elevated view of the locking mechanism of the foldable crate.
Figures 4A, 4B, 5A, 5B:
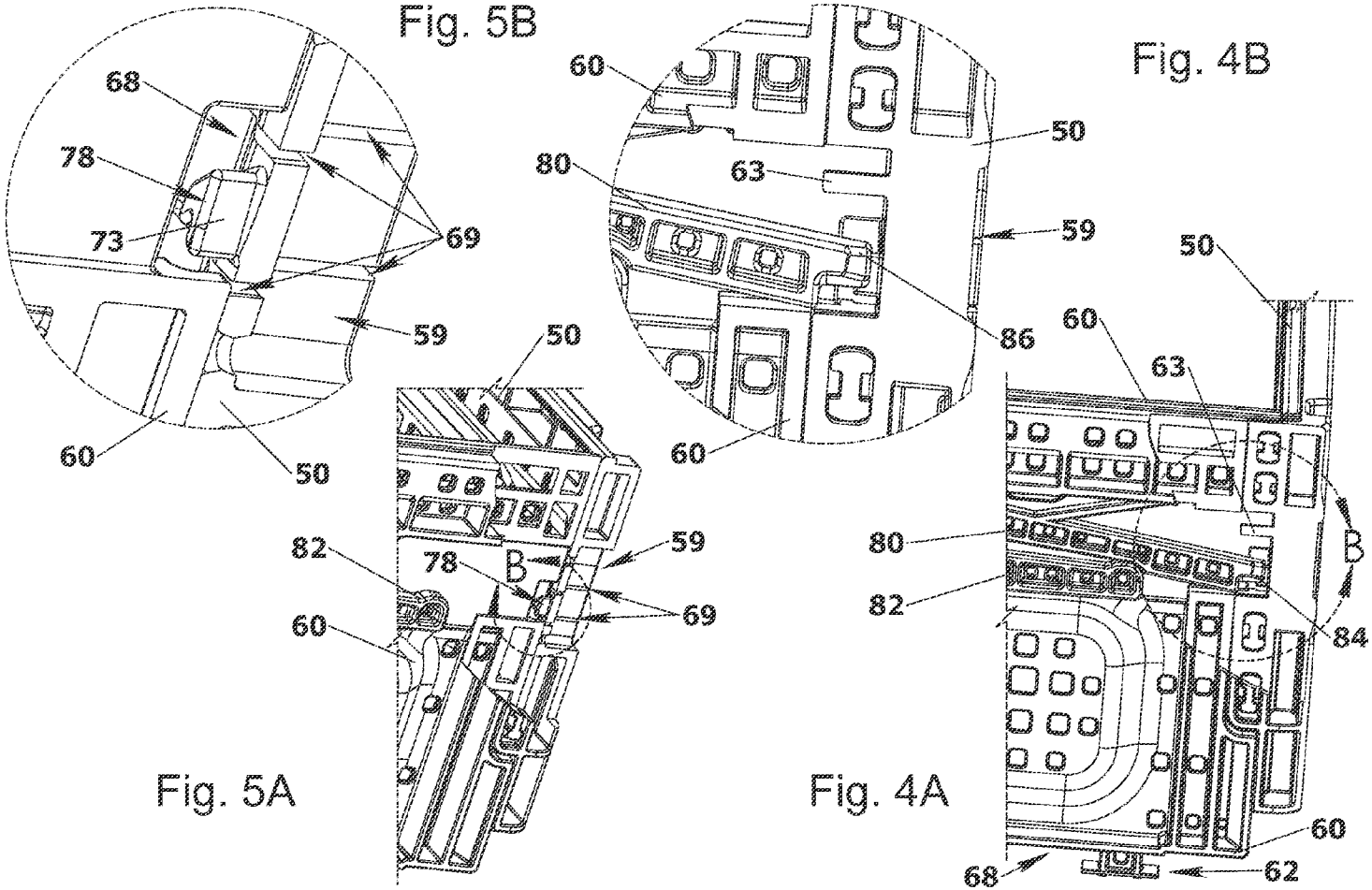
FIG. 4A is an elevated frontal cut-away view of the flaking sidewall, showing a terminal portion of a rotary locking element of the locking mechanism of the foldable crate.
FIG. 4B is an enlarged elevated frontal cut-away view of the flaking sidewall, showing a terminal portion of a rotary locking element, shown in FIG. 5A.
FIG. 5A is an elevated perspective frontal cut-away view of the flaking sidewall, showing an inwardly facing protrusion on the longitudinal sidewall.
FIG. 5B is an enlarged elevated perspective frontal cut-away view of the flaking sidewall, showing the inwardly facing protrusion on the longitudinal sidewall, shown in FIG. 5A.

FIGS. 1 and 2 show components of an embedment of foldable crate 30 as well as locking elements 80 thereof. Foldable crate 30 comprises base platform 32. Base platform 32 has a plurality of structural recesses 34, disposed about longitudinal portion 36 of base platform 32 and structural recesses 38 disposed about flanking portion 40 thereof. The superior face of longitudinal portions 36 of base platform 32 are positioned somewhat higher than the superior face of flanking portion 40.

Foldable crate 30 further comprises a pair of longitudinal sidewalls 50 and a pair of flanking sidewalls 60, of which just a single sidewall from each pair is shown. Longitudinal sidewalls 50 include a plurality of structural elements 52, disposed about bottom portion 54 of the former, whereas flanking sidewalls 60 include a plurality of structural elements 62, disposed about bottom portion 64 of sidewalls 60. Structural elements 52 disposed about bottom portion 54 of longitudinal sidewalls 50 further comprise longitudinal pivots 42 configured to form a hinged connection with structural recesses 34, disposed about longitudinal portion 36 of base platform 32; whereas structural elements 62, disposed about bottom portion 64 of flanking sidewalls 60 further comprise flanking 44 pivots, configured to form a hinged connection with structural recesses 38 disposed about flanking portion 40 of base platform 32 of foldable crate 30. Optionally, at least one of pivots 42 or 44 is a single extended rod, typically metallic, threaded respectively throughout the entire length of longitudinal portion 36 or flanking portion 40 of base platform 32.

Structural recesses 34, disposed about longitudinal portions 36 of base platform 32 as well as with structural recesses 38 disposed about flanking portions 40 of base platform 32 typically include apertures (not shown) configured to receive longitudinal pivots 42 and/or flanking 44 pivots, respectively, thereby forming a hinged connection between longitudinal sidewalls 50 and longitudinal portion 36 as well as flanking sidewalls 60 flanking portions 40 of base platform 32. Longitudinal portions 36 of base platform 32 embodying structural recesses 34 are positioned somewhat higher than flanking structural recesses 38 disposed about flanking portion 40 of base platform 32 embodying structural recesses 38, whereas longitudinal pivots 42 are positioned somewhat higher than flanking pivots 44; thereby providing for folding flanking sidewalls 60 inwardly towards bottom and then folding longitudinal sidewalls 50 on top of flanking sidewalls 60 in a folded conformation (not shown) foldable crate 30.

Longitudinal sidewalls 50 include tabs 56, adapted to serve as gripping handles. Longitudinal sidewalls 50 include flanking facets 58 extending essentially perpendicularly along a portion of the vertical edges of longitudinal sidewalls 50. It is further noted that flanking facets 58 of longitudinal sidewalls 50 preferably form enclosed channels 59 within longitudinal sidewalls 50.

Flanking sidewalls 60 include tab 66, adapted to serve as a gripping handle. It is noted that flanking sidewalls 60 include side recesses 68, forming an opening sidewalls 60 allowing passage of protrusion 78 of longitudinal sidewalls 50 upon opening and folding crate 30. Flanking sidewalls 60 include flanking struts 72, forming a channel which is in continuum with enclosed channels 59 formed by flanking facets 58 within longitudinal sidewalls 50.

Flanking sidewalls 60 comprise structured centric recess 70, essentially surrounding tab 66. Structured centric recess 70, of flanking sidewall 60, is adapted to accommodate unlocking element 82. Structured centric recess 70 in flanking sidewalls 60 comprises a couple of grooves 76 along a portion of the sides thereof, adapted to accommodate ridges or extensions (not shown) of unlocking element 82 and sustain vertical displacement of the latter within the former.

Referring now to FIG. 3A to 5B which show rotary locking elements 80 in greater details. Rotary locking elements 80 are pivoted on pivots 84 positioned typically somewhat offset structured centric recess 70, in flanking sidewall 60. Rotary locking elements 80 further comprise or embody leaf-springs 88, extending from the top face upwards and towards the terminal portion 86 of rotary locking elements 80.

Locking elements 80 are threaded into channels 59 in flanking sidewalls 60, underneath flanking struts 72. It is noted that the channels formed underneath flanking struts 72 are somewhat wider than locking elements 80; thereby sustaining radial displacement of the latter within the former. Locking elements 80 are furnished with pivots, which are threaded into apertures 84, at the top portion of flanking sidewalls 60. Locking elements 80 are rotatable upon pivots threaded into apertures 84, in flanking sidewalls 60; thereby sustaining radial displacement of the terminal portion of locking elements 80 within channels formed underneath flanking struts 72 in flanking sidewalls 60.

Longitudinal sidewalls 50 comprise structured protrusions 78, extending inwardly from the inner faces of longitudinal sidewalls 50. U-shaped cut 69 is formed essentially surrounding protrusions 78, thereby rendering protrusions 78 outwardly displaceable, upon pushing onto protrusions 78 in an outward direction, against the biasing force exerted upon deformation of the material at the basis of U-shaped cut 69. Structured protrusions 78 of longitudinal sidewalls 50 comprise upwardly oriented back upper face 71 and essentially vertically oriented back upper face 73, slightly upwardly inclined backwards.

Underneath flanking struts 72, flanking sidewalls 60 comprise recesses 68 defining an opening towards the interior of crate 30. Recesses 68 in flanking sidewalls 60 allow structured protrusions 78 of longitudinal sidewalls 50 to surpass the terminal portions of locking elements 80, while unfolding crate 30 into open conformation, shown in FIG. 1. Terminal portions of locking elements 80 preferably comprise chamfered or beveled terminal front face 86. Chamfered or beveled terminal front face 86 of locking elements 80 is to some extent inwardly slanted, facing somewhat towards the corner of crate 30.

To unfold crate 30 into open conformation, shown in FIG. 1, initially longitudinal sidewalls 50 are elevated and consequently rotated upwardly and away from base platform 32, until the former are erected essentially perpendicularly to the latter. Then flanking sidewalls 60 are elevated and consequently rotated upwardly and away from base platform 32, until terminal portions of locking elements 80 collide from behind with structured protrusions 78.

Upon collision of structured protrusions 78 with terminal portions of locking elements 80 and particularly with chamfered or beveled terminal front face 86 thereof, structured protrusions 78 are displaced in an outward direction, while the material at the basis of U-shaped cut 69 is somewhat bent or deformed, forming a biasing force urging structured protrusions 78 in an inward direction. Alternatively or additionally, upon collision of terminal portions of locking elements 80 with structured protrusions 78, terminal portions of locking elements 80 are displaced in an upward direction, while being contiguously translated upon the surface of upwardly oriented back upper face 71 of structured protrusions 78 on longitudinal sidewalls 50.

Ultimately, upon elevating flanking sidewalls 60 and consequently rotating the same upwardly and away from base platform 32, until the former are erected essentially perpendicularly to the latter, terminal portions of locking elements 80 surpass structured protrusions 78. Upon surpassing terminal portions of locking elements 80, structured protrusions 78 are spontaneously displaced in an inward direction, due to the biasing force formed by the deformed or bent material at the basis of U-shaped cut 69 spontaneously urging structured protrusions 78 in an inward direction. Alternatively or additionally upon surpassing structured protrusions 78, terminal portions of locking elements 80 are spontaneously displaced in a downward direction, due to the biasing force exerted by leaf-springs 88 of locking elements 80, bouncing against inner top face of the top portion of flanking sidewalls 60.

Upon surpassing structured protrusions 78, terminal portions of locking elements 80 become locked in front of structured protrusions 78 of longitudinal sidewalls 50, whereby flanking sidewalls 60 become locked in a perpendicular orientation relatively to base platform 32, rendering crate 30 locked in open conformation, shown in FIG. 1.

Unlocking element 82 is slidable in structured centric recess 70, of flanking sidewalls 60. Ridges or extensions (not shown) of unlocking element 82 are threaded into grooves 76 of about structured centric recess 70 and slidable therein. Vertical translation of unlocking element 82 upwards is restricted by the length of grooves 76. Leaf-springs 88 spontaneously drive unlocking element 82 in a downward direction, by bouncing against inner top face of the top portion of flanking sidewalls 60.

Upon forceful manual elevation of unlocking element 82 in an upward direction, terminal portions of unlocking element 82 exert rotational torque onto locking elements 80, causing locking elements 80 to rotate upon pivots threaded into apertures 84, in flanking sidewalls 60, so that the terminal portions of locking elements 80 are radially displaced in an upward direction and assume a higher position within channels formed underneath flanking struts 72 in flanking sidewalls 60; thereby rendering crate 30 readily foldable into folded conformation (not shown).

Enclosed channels 59 formed by flanking facets 58 within longitudinal sidewalls 50 preferably comprise separation bumper elements 63, extending into the channels underneath flanking struts 72 in flanking sidewalls 60. Separation bumper elements 63 typically include an outwardly slanted bottom face (not shown), facing essentially inwardly and downwardly. Upon forceful manual elevation of unlocking element 82 in an upward direction, the top faces of terminal portions of unlocking element 82 collide with separation bumper elements 63, preferably with an outwardly slanted bottom face thereof, thereby a normal force is exerted onto terminal portions of unlocking element 82 and in turn onto flanking sidewalls 60 essentially inwardly and downwardly, forming a rotational torque onto flanking sidewalls 60, causing flanking sidewalls 60 to commence rotating upon flanking pivots 44, towards base platform 32, thus initiating the folding of crate 30 into folded conformation (not shown).

It is noted that deepened bottom portion in structured centric recess 70 is used for manual access to unlocking element 82 from underneath. It is further noted that the top face of the central portion of unlocking element 82 is preferably disposed not higher than the bottom face of tab 66 in flanking sidewalls 60, when unlocking element 82 is in a released position, shown in FIG. 1; whereas when unlocking element 82 is in an elevated position (not shown), the top face of the central portion of unlocking element 82 partially obstructs tab 66 in flanking sidewalls 60; thereby preventing inadvertent usage of crate 30, while unlocking element 82 is in an elevated position (not shown).

Upon release of forceful elevation of unlocking element 82 in an upward direction, leaf-springs 88 of locking elements 80, spontaneously drive locking elements 80 in a downward direction which in turn drive unlocking element 82 in a downward direction as well. Upon spontaneous translation of unlocking element 82 in a downward direction, locking elements 80 are capable to assume a lower position within channels formed underneath flanking struts 72 in flanking sidewalls 60; thereby rendering crate 30 readily transformable into open conformation, shown in FIG. 1.

It is noted that due to the modularity of crate 30, unlocking element 82 as well as locking elements 80 are readily replaceable in individual manner. Moreover even without or with dysfunctional unlocking element 82, crate 30 still can be assembled into open conformation shown in FIG. 1 and used for its purpose.

It is further noted that due to geometrical proportions of unlocking element 82 relatively to locking elements 80, a translational lever is formed wherein the terminal portion of unlocking element 82 exerts a force onto a centric portion of locking elements 80, whereby the terminal portion of locking elements 80 is consequently elevated a greater distance than the terminal portion of unlocking element 82. Consequently upon effecting a relatively minor vertical translation of unlocking element 82, a relatively major vertical translation of the terminal portion of locking elements 80 is achieved; rendering crate 30 more easily and readily foldable into a folded configuration (not shown).

Figure 6B:
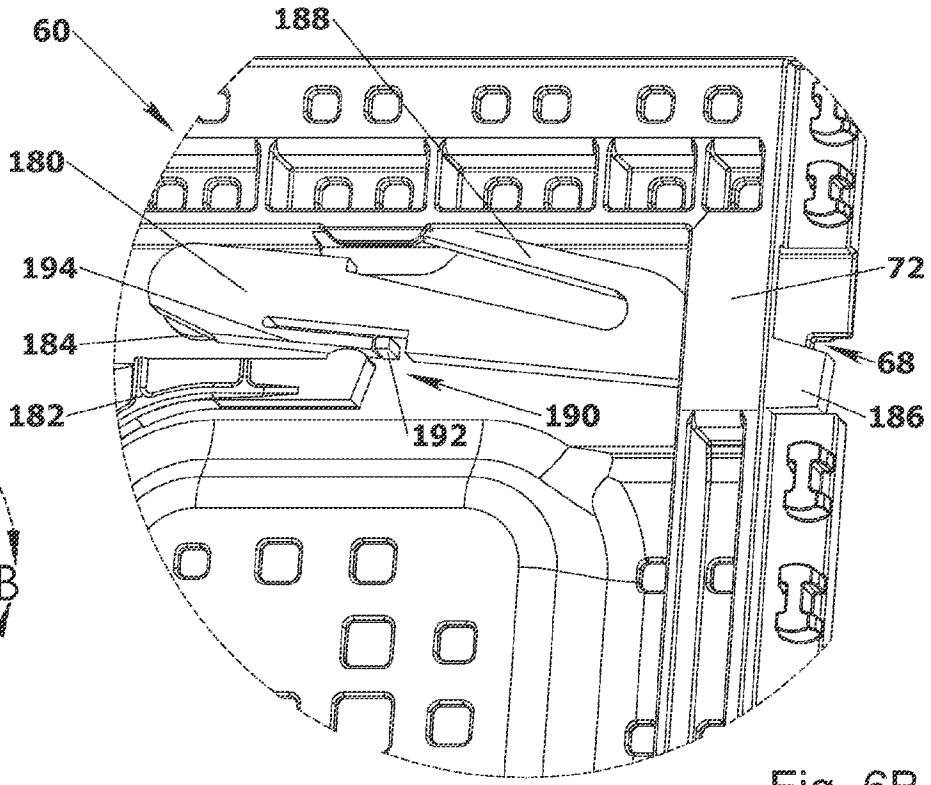
FIG. 6B is an enlarged frontal view of the flaking sidewall, incorporating another embodiment of locking/unlocking mechanism, with a safety catch feature preventing inadvertent opening of the crate, shown in FIG. 6A.
Figure 6A:
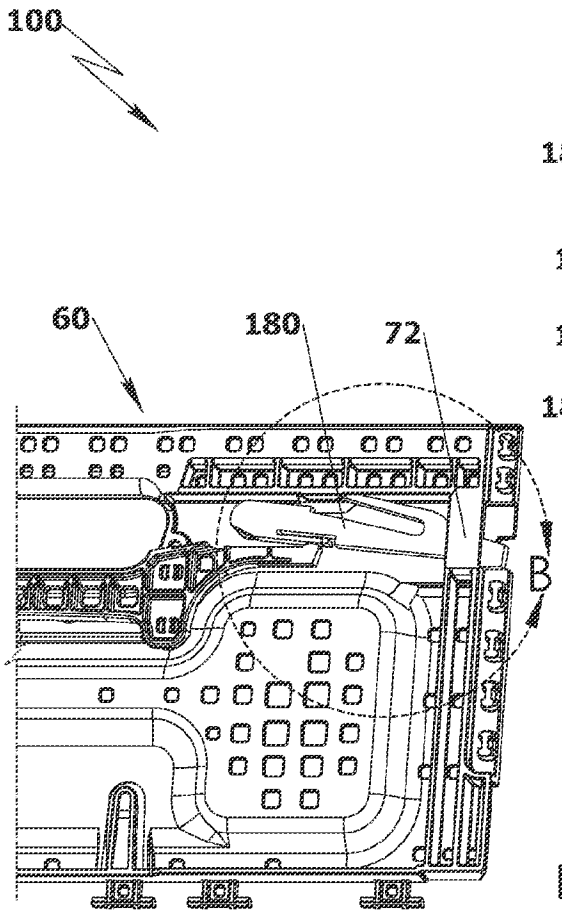
FIG. 6A is a perspective frontal view of the flaking sidewall, incorporating another embodiment of locking/unlocking mechanism, with a safety catch feature preventing inadvertent opening of the crate.

In accordance with some preferred embodiments of the present invention, reference is now made to FIGS. 6A and 6B showing flaking sidewall 60, employing safety catch mechanism 190 preventing inadvertent opening of rotary locking element 180. Rotary locking element 180 is pivoted on pivot 184 positioned typically somewhat offset the structured centric recess, in flanking sidewall 60. Rotary locking element 180 further comprises or embodies leaf-spring 188, extending from the top face upwards and towards pivot 184 of rotary locking element 180.

Rotary locking element 180 is threaded into channel in flanking sidewall 60, underneath flanking strut 72. It is noted that the channel formed underneath flanking struts 72 is somewhat wider than terminal portion 186 of locking element 180; thereby sustaining radial displacement of the latter within the former. Locking element 180 is rotatable upon pivot 184, in flanking sidewalls 60; thereby sustaining radial displacement of terminal portion 186 of locking elements 180 within channel formed underneath flanking strut 72 in flanking sidewalls 60.

Flanking sidewall 60 shown in FIGS. 6A and 6B further comprises exemplary safety catch mechanism 190 preventing inadvertent elevation rotation of rotary locking element 180, within channel formed underneath flanking strut 72 in flanking sidewalls 60. Rotary locking element 180 comprises exemplary extended protrusion 194. The terminal portion of extended protrusion 194 is configured to be bent, folded or otherwise displaced in an upward direction, towards rotary locking element 180, upon a force exerted from underneath, by the terminal portion of exemplary unlocking element 182.

Upon forceful elevation of unlocking element 182 in an upward direction, top terminal portion of unlocking element 182 exerts a force onto the terminal portion of extended protrusion 194; whereby the terminal portion of extended protrusion 194 is displaced in an upward direction, towards rotary locking element 180. Thereafter rotary locking element 180 is capable to perform rotation upon pivot 184, upon further elevation of unlocking element 182 in an upward direction, thereby sustaining radial displacement of terminal portion 186 of locking elements 180 within channel formed underneath flanking strut 72 in flanking sidewalls 60.

However if no forceful elevation in an upward direction is applied to unlocking element 182, locking element 180 is locked in place and rotation of rotary locking element 180 upon pivot 184 is precluded, because the terminal face of extended protrusion 194 is pushed against detent 192, whereby radial displacement of terminal portion 186 of locking elements 180 within channel formed underneath flanking strut 72 in flanking sidewalls 60 is prevented. Consequently if an attempt to rotate locking element 180 in an upward direction is made, for instance upon opening of the foldable crate, safety catch mechanism 190 prevents rotation of rotary locking element 180 upon pivot 184, because the terminal face of extended protrusion 194 is pushed against detent 192; whereby inadvertent folding of the foldable crate is prevented.

It will be appreciated by persons skilled in the art that the present invention is not limited by what has been particularly shown and described herein above. Rather the scope of the invention is defined by the claims which follow:

What is claimed is:

1. A foldable crate comprises:

(a) a base platform, said base platform comprising:
  (1) a pair of longitudinal portions;
  (2) a pair of flanking portions;
  (3) at least one structural element, disposed adjacently to said longitudinal portions of said base platform;
  (4) at least one structural element, disposed adjacently to said flanking portions of said base platform;

(b) a pair of longitudinal sidewalk, each one of said longitudinal sidewalls comprising:
  (1) at least one structural element, configured to form a hinged connection with said at least one structural element disposed adjacently to said longitudinal portion of said base platform;
  (2) a tab, configured to serve as a gripping handle;
  (3) a pair of structured protrusions, extending inwardly from an inner surface of said longitudinal sidewall;
  (4) a U-shaped cut essentially surrounding said structured protrusions, thereby rendering said structured protrusions laterally displaceable, wherein upon exerting a force onto said structured protrusions, a biasing force is formed by a material at the basis of said U-shaped cut;

(c) a pair of flanking sidewalls, each one of said flanking sidewalk comprising:
  (1) at least one structural element, configured to form a hinged connection with said at least one structural element disposed adjacently to said flanking portion of said base platform;
  (2) a tab, configured to serve as a gripping handle;
  (3) a structured centric recess, essentially surrounding said tab;
  (4) a pair of flanking struts, forming a pair of channels in side portions of said flanking sidewall;
  (5) a pair of side recesses, forming openings on interior side of said flanking sidewall, configured to sustain a passage of said structured protrusions on said longitudinal sidewall through said openings;

(d) a pairs of rotary locking elements disposed on an exterior side of each one of said flanking sidewalls, each one of said locking elements comprising:
  (1) a pivot connectable to said flanking sidewall, upon which said locking element is rotatable;
  (2) a leaf-spring extending from a top face of said locking element upwardly, biasing said rotary locking element into a lower position;
  (3) a chamfered terminal front face, being inwardly slanted;

(e) an unlocking element disposed in said structured centric recess in said flanking sidewall, essentially underneath said tab, said unlocking element comprising:
  (1) at least one structural element for operatively connecting to said flanking sidewall, configured to sustain vertical translation of said unlocking element;
  (2) a pair of terminal portions, wherein each one of said terminal portions is configured to confer a rotational torque to said rotary locking element upon forceful elevation of said unlocking element in an upward direction.

2. The crate as in claim 1, wherein said unlocking element comprises side ridges and wherein said side ridges of said unlocking element are inserted into grooves positioned along sides of said structured centric recess and slidable therein.

3. The crate as in claim 1, wherein said longitudinal sidewalk further comprise separation bumper elements, wherein upon elevation of said unlocking element in an upward direction, top faces of terminal portions of said rotary locking elements collide with said separation bumper elements, thereby forming a rotational torque onto said flanking sidewalls towards base platform, thus initiating folding of said crate.

4. The crate as in claim 3, wherein said separation bumper elements comprise an outwardly slanted bottom face, facing essentially inwardly and downwardly.

5. The crate; as in claim 1, further comprises a safety catch mechanism preventing inadvertent rotation of said rotary locking elements.

6. The crate as in claim 5, wherein said safety catch mechanism preventing inadvertent rotation of said rotary locking elements comprises:

(a) an extended protrusion forming a part of said rotary locking element, wherein said extended protrusion is configured to assume at least two different conformations selected from the group consisting of:
  (1) an activated conformation wherein a terminal portion of said extended protrusion is displaced in an upward direction, towards said rotary locking element, upon a force exerted from underneath by a terminal top portion of said unlocking element;
  (2) a default conformation wherein said extended protrusion is not displaced in said upward direction;

(b) a detent, said detent is configured to interact with said terminal portion of said extended protrusion in said default conformation, thereby preventing inadvertent rotation of said rotary locking element; said detent is further configured not to interact in said activated conformation, thereby sustaining rotation of said rotary locking element, upon a force exerted from underneath by said terminal top portion of said unlocking element.

7. A foldable crate comprises:

(a) a base platform comprising:

(1) a longitudinal portion, comprising at least one structural element, disposed adjacently to said longitudinal portion;

(2) a flanking portion, comprising at least one structural element, disposed adjacently to said flanking portion;

(b) at least one longitudinal sidewall comprising:

(1) at least one structural element, configured to form a hinged connection with said at least one structural element disposed adjacently to said longitudinal portion of said base platform;

(2) at least one structured protrusion, extending inwardly from an inner side of said longitudinal sidewall;

(c) at least one flanking sidewalk comprising at least one structural element, configured to form a hinged connection with said at least one structural element disposed adjacently to said flanking portion of said base platform;

(d) at least one rotary locking element disposed on an exterior side of said flanking side-wall, said rotary locking element comprising:

(1) a pivot connectable to said flanking sidewalk upon which said locking element is rotatable;

(2) a biasing means configured to spontaneously drive said rotary locking element into a lower position;

(e) at least one unlocking element comprising:

(1) at least one structural element operatively attachable to said flanking sidewall, configured to sustain vertical translation of said unlocking element;

(2) a pair of terminal portions, wherein each one of said terminal portions is configured to confer a rotational torque to said rotary locking element upon forceful elevation of said unlocking element;

wherein geometrical proportions of said unlocking element relative to said rotary locking element define a translational lever, wherein said terminal portion of said unlocking element exerts a force onto a centric portion of locking elements, whereby said terminal portion of said rotary locking element is translatable a greater distance than said terminal portion of unlocking element.

8. The crate as in claim 7, wherein said flanking sidewall further comprises a U-shaped cut essentially surrounding said structured protrusion, thereby rendering said structured protrusion laterally displaceable, wherein upon exerting a force onto said structured protrusion, a biasing force is formed by a material at the basis of said U-shaped cut.

9. The crate as in claim 7, wherein said flanking sidewall further comprises at least one side recess, forming an opening on an inner side of said flanking sidewall, configured to sustain a passage of said structured protrusion of said longitudinal sidewall through said opening.

10. The crate as in claim 7, wherein said longitudinal sidewalls further comprise separation bumper elements, wherein upon elevation of said unlocking element in an upward direction, top faces of terminal portions of said rotary locking element collide with said separation bumper elements, thereby forming a rotational torque onto said flanking sidewalls towards base platform, thus initiating folding of said crate.

11. The crate as in claim 10, wherein said separation bumper elements comprise an outwardly slanted bottom face, facing essentially inwardly and downwardly.

12. The crate, as in claim 8, further comprises a safety catch mechanism preventing inadvertent rotation of said rotary locking elements.

13. The crate as in claim 12, wherein said safety catch mechanism preventing inadvertent rotation of said rotary locking elements comprises:

(a) an extended protrusion forming a part of said rotary locking element, wherein said extended protrusion is configured to assume at least two different conformations selected from the group consisting of:

(1) an activated conformation wherein a terminal portion of said extended protrusion is displaced in an upward direction, towards said rotary locking element, upon a force exerted from underneath by a terminal top portion of said unlocking element;

(2) a default conformation wherein said extended protrusion is not displaced in said upward direction;

(b) a detent, said detent is configured to interact with said terminal portion of said extended protrusion in said default conformation, thereby preventing inadvertent rotation of said rotary locking element; said detent is further configured not to interact in said activated conformation, thereby sustaining rotation of said rotary locking element, upon a force exerted from underneath by said terminal top portion of said unlocking element.

14. The crate as in claim 7, wherein said structured protrusion, extending inwardly from said inner surface of said longitudinal sidewall comprises an upwardly slanted back upper face.

15. The crate as in claim 7, wherein said flanking sidewall comprises at least one flanking strut, forming a channel in a side portion of said flanking sidewall.

16. The crate as in claim 7, wherein said flanking sidewall comprises at least one side recess, forming an opening on interior side of said flanking sidewall, configured to sustain a passage of said structured protrusion on said longitudinal sidewall through said opening.

17. The crate as in claim 7, wherein said rotary locking element comprises a chamfered terminal front face, being inwardly slanted.

18. The crate as in claim 7, wherein said at least one rotary locking element and said at least one unlocking element are modular and readily replaceable in individual manner.

19. The crate as in claim 7, wherein geometrical proportions of said unlocking element relatively to said rotary locking element define a translational lever, wherein upon effecting a relatively minor vertical translation of said unlocking element, a relatively major vertical translation of said terminal portion of said locking element is achieved; thereby rendering crate readily foldable.

* * * * *